United States Patent [19]

Förster et al.

[11] 4,148,357

[45] Apr. 10, 1979

[54] HEAT EXCHANGER MATRIX FOR RECUPERATIVE HEAT EXCHANGE AMONG THREE MEDIA AND MODULAR HEAT EXCHANGERS COMBINING A PLURALITY OF SUCH MATRICES

[75] Inventors: Siegfried Förster, Alsdorf; Manfred Kleemann, Quadrath, both of Fed. Rep. of Germany

[73] Assignee: Kernforschungsanlage Julich Gesellschaft m. beschränkter Haftung, Julich, Fed. Rep. of Germany

[21] Appl. No.: 735,205

[22] Filed: Oct. 26, 1976

[30] Foreign Application Priority Data

Nov. 3, 1975 [DE] Fed. Rep. of Germany ..... 2549053

[51] Int. Cl.[2] ..... F28F 3/02

[52] U.S. Cl. ..... 165/140; 165/166; 165/175

[58] Field of Search ..... 165/140, 166, 167

[56] References Cited

U.S. PATENT DOCUMENTS

| | | | |
|---|---|---|---|
| 218,356 | 8/1879 | Zastrow | 165/140 |
| 1,775,103 | 9/1930 | Hume | 165/166 |
| 3,111,982 | 11/1963 | Ulbricht | 165/166 |
| 3,473,604 | 10/1969 | Tiefenbacher | 165/166 |
| 3,587,731 | 6/1971 | Hays | 165/140 |
| 4,002,201 | 1/1977 | Donaldson | 165/140 |
| 4,029,146 | 6/1977 | Hart et al. | 165/166 |
| 4,042,018 | 8/1977 | Zebuhr | 165/166 |

FOREIGN PATENT DOCUMENTS

| | | | |
|---|---|---|---|
| 2029783 | 6/1971 | Fed. Rep. of Germany | 165/140 |

*Primary Examiner*—Charles J. Myhre
*Assistant Examiner*—Sheldon Richter
*Attorney, Agent, or Firm*—Flynn & Frishauf

[57] ABSTRACT

Two identically folded strips enclose an intermediate space accessible at the edges of the strip, and the fold cavities opening to the outside of the strip structure are closed off at the strip edges and covered by outside cover plates over their central portions, so that one medium may be caused to flow through each of the sets of outside fold cavities and a third medium through the intermediate space. The third medium flows countercurrent to the direction of flow of the other two. Modules of four such matrices utilize inlet and outlet ducts so that the two or four matrices in a compact modular structure can be structurally repeated in accordance with the number of modules desired in the particular application. The inlet and outlet ducts have tapering flow cross-sections.

5 Claims, 4 Drawing Figures

HEAT EXCHANGER MATRIX FOR RECUPERATIVE HEAT EXCHANGE AMONG THREE MEDIA AND MODULAR HEAT EXCHANGERS COMBINING A PLURALITY OF SUCH MATRICES

CROSS-REFERENCE TO RELATED APPLICATION OF THE SAME OWNER

U.S. Ser. No. 735,135, filed Oct. 26, 1976, attorney docket FF 6453, claiming priority of German application P 25 49 053.3.

This invention relates to a heat exchanger matrix of the folded strip or plate type for recuperative heat exchange among three media and a heat exchanger combining a multiplicity of such heat exchanger matrices together with inlet and outlet channels for the media in a coordinated structure. Heat exchanger matrices of this type utilize metal strips corrugated or folded back-and-forth to provide transverse chambers on opposite sides of the strip and are equipped with cover plates tangent to the ridges of the folds on both sides and with end closures of the edges of the strips for closing off the chambers produced by the folds. The cover plates leave open an access to the fold cavities through which in each case one of the media can be led to flow through the cavities parallel to the folds or corrugations.

A heat exchanger with a strip type heat exchanger matrix of the above type is well known for heat exchange between two media. A heat exchanger of a similar type for three media was disclosed in U.S. Pat. No. 3,126,942 in which the spaces through which the media were caused to flow were bounded by plates pressed or stamped into a shape similar to that of corrugated metal used for structural purposes. This heat exchanger is not suitable for high levels of mass flow because of the high pressure losses that appear particularly in the inlet region of the heat exchanger matrix. Furthermore, on account of the unfavorable connections to, and flow guiding in, chambers between the corrugated metal plates where heat transfer took place, the matrix surfaces available for heat exchange in the device were utilized only to a low degree.

For the simultaneous heat exchange among three media, the heat exchanger disclosed in German published patent application (OS) 2 029 783 is also known. In this case the spaces through which the media flow for heat exchange are provided by a multiplicity of plates stacked one above the other, each of which plate consists of two sheets of metal pressed together and equipped with profile members. When such a heat exchanger is to be utilized for the exchange of heat among media among which there are great differences in pressure, it is impossible to provide the necessary sealing of the several flow paths of the respective media from each other with an effectiveness sufficient to meet the stringent requirements except with great difficulty and care in construction. Furthermore, the matrix surfaces available for heat transfer in this heat exchanger are also utilized insufficiently, which leads to a low heat transfer capacity and low efficiency of the heat exchanger.

It is an object of the present invention to provide a heat exchanger with a heat exchanger matrix of the folded strip type which is suitable for heat transfer, and expecially recuperative heat exchange, among three media and, furthermore, a heat exchanger in which the flow paths available for the heat transfer process can handle a large flow of the respective media with pressure losses that are as small as possible and with extensive utilization of the heat transfer capabilities of the matrix surfaces. It is a further object of this invention to provide such a heat exchanger that will also be economical to manufacture.

The starting point for realizing the objects of the present invention is the heat exchanger matrix disclosed in German published patent application (OS) 2 408 462 which is designed for heat exchange between two media. This heat exchange matrix consists of a folded strip with U-shaped folds and cover plates tangent to the ridges of the folds forming parallel chambers. The cover plates do not extend over the whole width of the strip and thus leave openings for a medium to enter into or leave the chambers provided behind the respective cover plates. The chambers formed by the folds are closed off at their ends at the edges of the strip, so that the inlets and outlets are from the sides rather than from the edges of the strip.

SUMMARY OF THE INVENTION

Briefly, two folded strips are used so as to combine to form a central chamber, or set of chambers, between them open at the edge of the strips, whereas the folds of the two strips that are open to the sides of the strips away from the other strip are closed at the edges of the strips and are in large part covered by cover plates on the outside of the folded strip structure. Thus, a first and a second medium can respectively be caused to flow through the outside fold chambers around the cover plates and a third medium can be caused to flow through the spaces between the strips from edge to edge of the strip. The third medium can be caused to flow countercurrent to the flow of the other two, in heat exchange relation with both of the other two. More particularly, the invention provides two embodiments of structures of the kind just outlined. In a first embodiment, two strips bent into identical series of folds are placed adjacent to each other in mirror-image relation. In this embodiment the folds are preferably symmetrical, which is to say that, in the case of U-shaped bends, the spacing between the flat portions of the strip is uniform. In a second embodiment, the folds are alternately narrower and wider, which is to say that, in the case of U-shaped bends, the parallel portions of each strip are alternately spaced by a first and narrower spacing and by a second and wider spacing. In this embodiment, the folds are interleaved so that a narrower fold of one strip projects into a wider fold of the other, making the central chamber in the form of a cavity of sinuous profile along the length of the strips. In this second embodiment, an edge strip folded with the main strip can be used to seal off each end of the narrower folds which provide the chambers accessible from the outside of the structure through which the first and second media are circulated with the help of cover plates.

Both of the embodiments above mentioned, constituting heat exchanger matrices of the present invention suitable for heat exchange among three media under conditions of high mass flow and large temperature and pressure differences, lend themselves very well to the construction of heat exchangers composed of a multiplicity of matrices according to the present invention, combined with inlet and outlet ducts for the media each of which connects with two or more matrices, in a highly compact and space-saving structure. It is possible to provide such structures in such a way that the inlet ducts taper down in cross-section and the outlet ducts widen in cross-section, as viewed in the direction of flow. In one form of multiple unit heat exchanger, this can be done by providing oblique partitions at right angles to back-to-back cover plates of adjacent matrices. In another form of multiple unit, this same objective can be obtained by arranging the matrices in V-shaped pairs. In each case, the combined unit can be provided utilizing a very large number of heat exchanger matrices, with the advantages of a modular type of construction which enables heat exchangers of various sizes to be made by the putting together of identical modules. Consequently, the heat exchangers of the invention make possible the fitting of a heat exchanger made up of production units in a highly economic manner to a very wide range of heat exchange requirements.

The heat exchangers according to the present invention are particularly useful for heat exchange in which the two outer sets of chambers serve for the flow of gaseous media and in which the central chambers serve for the flow of a liquid medium.

The invention is further described by way of illustrative example with reference to the accompanying drawings, in which.

Figure 1:
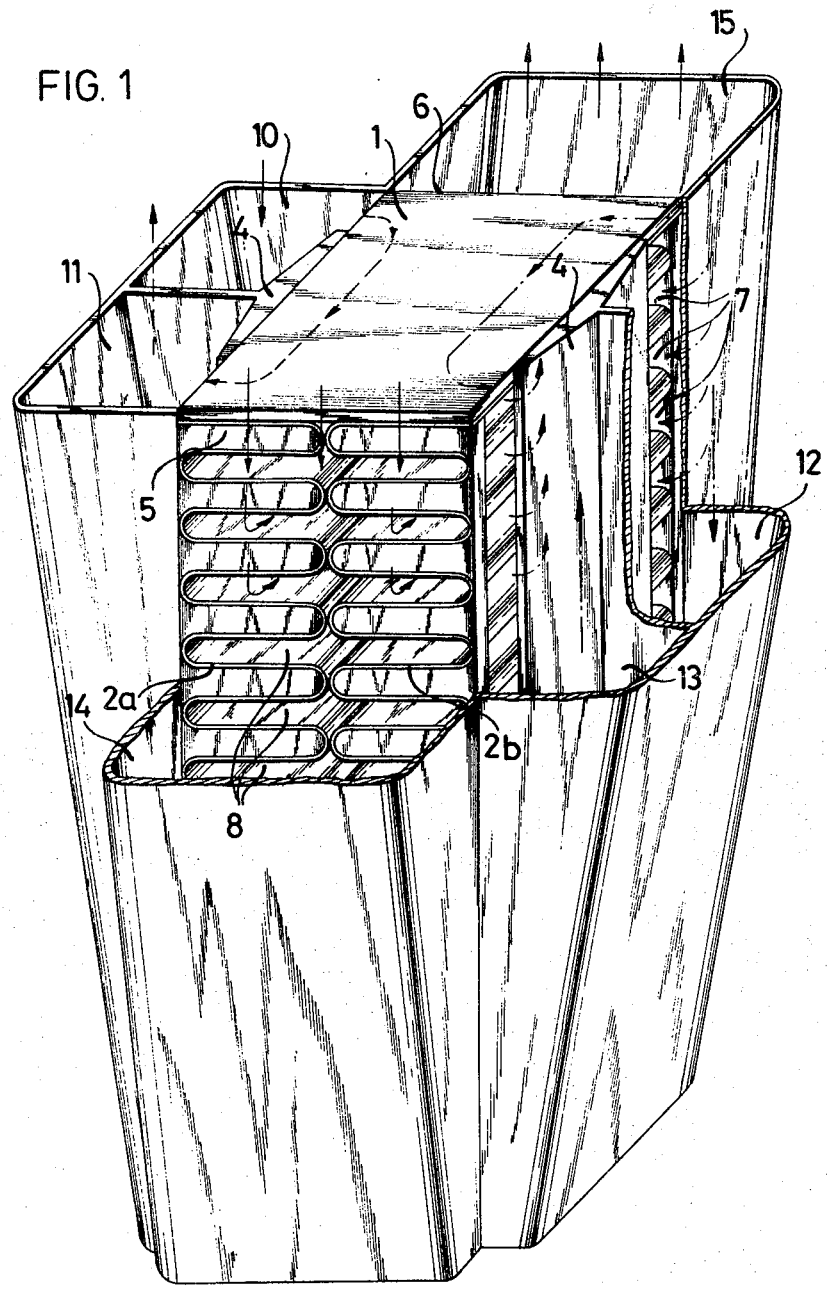
FIG. 1 is a perspective view, partly cut away and shown in section, of the above-described first embodiment of a heat exchanger matrix according to the present invention.
Figure 2:
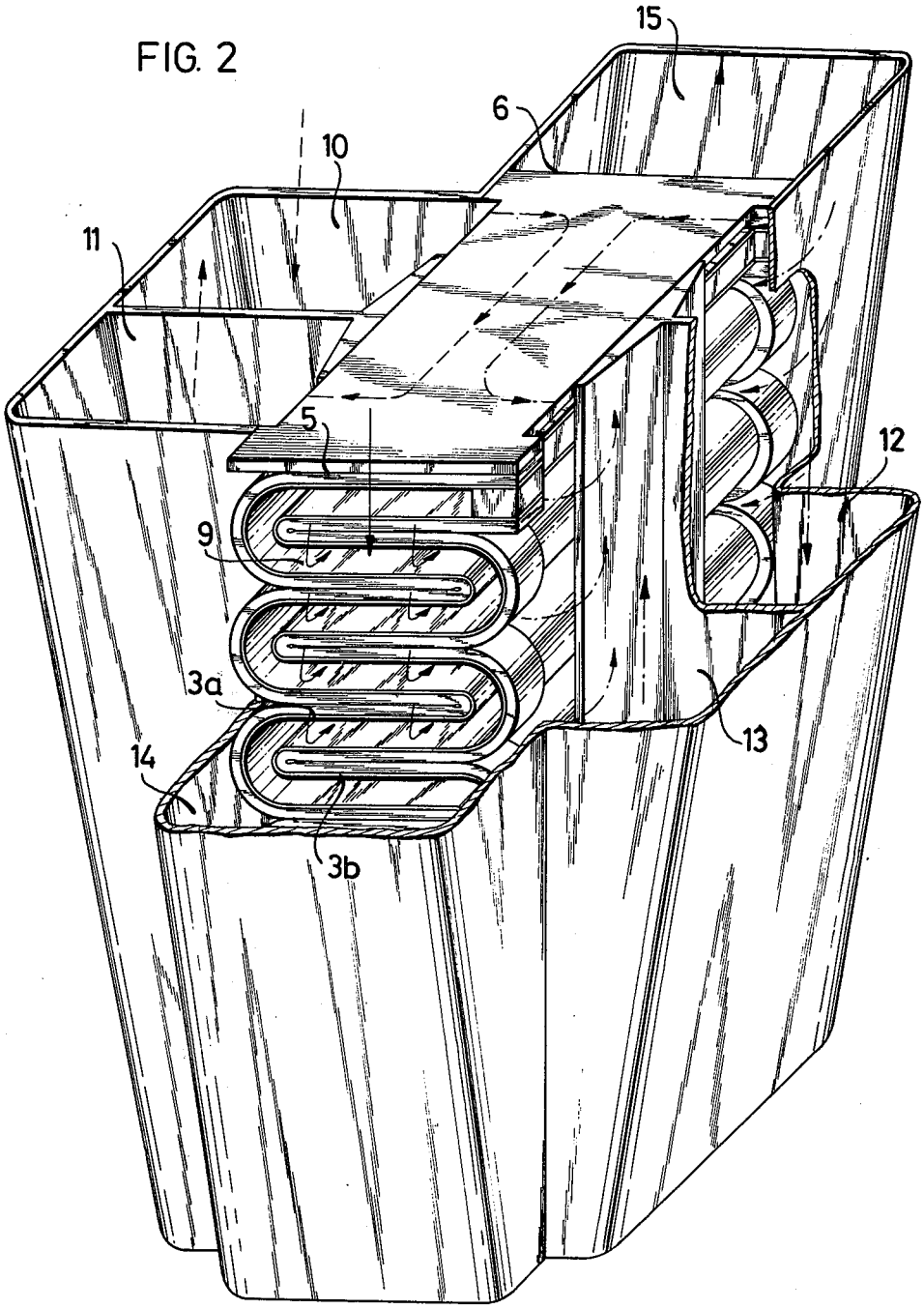
FIG. 2 is a similar view of a heat exchanger matrix according to the above-mentioned second embodiment of the invention.

As shown in FIGS. 1 and 2 representing the first and second embodiments of heat exchanger matrices according to the present invention, these matrices are formed from the regular series of folds of strips 2*a* and 2*b* in one case and 3*a* and 3*b* in the other case. The external fold chambers of each strip are in both cases covered by cover plates 4 applied to the outer side of both strips, but not extending over the full width of the strips. Chambers are formed between the cover plates and the folds of the strips 2*a* and 2*b* in one case and 3*a* and 3*b* in the other. These chambers are closed off at the edges of the strip 5 and 6 by soldering or welding. Particularly in the case of the second embodiment, the sealing off of the ends of the cavities produced by the folds, that is, at the edges of the strips, is preferably carried out by providing sealing strips along the edges of the heat exchanger strips before the folding is done, these sealing strips being of such thickness that when the folding is done, an end-seal of the chamber will be produced. Inlet and outlet openings 7 are provided for the outer chambers of the matrix beyond each edge of the cover plate, whereas the inlet and outlet for the third medium, which flows through the central chambers 8, 9 between the strips are provided at the edges of the strips.

In FIG. 1, which illustrates a first embodiment of a heat exchange matrix for three media according to the present invention, the central chamber 8 is the space between two adjacent but spaced strips 2*a*, 2*b* that were folded in the identical way and disposed so as to face each other in mirror-image relation. FIG. 2 shows an illustrative example of the second embodiment, in which the matrix consists of interleaved strips having alternate wider and narrow folds in U-shaped profile in each case. More generally, the strips are bent back-and-forth in accordance with a profile that will enable interleaving of the strips in such a way that a combined uniform folded structure is provided and preferably so that a substantially constant spacing between the individual folds of the respective strips is provided. In both embodiments, the intermediate spaces 8, 9 between the strips are open at both edges of the strips, which is to say at both ends 5 and 6 in the direction of the fold ridges, of the space between the strips.

The inlets and outlets on the two sides of the heat exchanger matrix and also the openings 5 and 6 at the strip edges for access to the intermediate space, 8 or 9 as the case may be, are covered by and communicate with ducts, particularly inlet ducts 10, 12 and 14 and outlet ducts 11, 13 and 15, for the respective media. Preferably these inlets and outlets are so determined that the medium flowing through the intermediate space 8 or 9 flows in countercurrent to the other two media. The inlet ducts 10 and 12 and the outlet ducts 11 and 13 for the respective media flowing through the outer chambers are, in the case of each medium, located adjacently on the same side of the structure.

Figure 3:
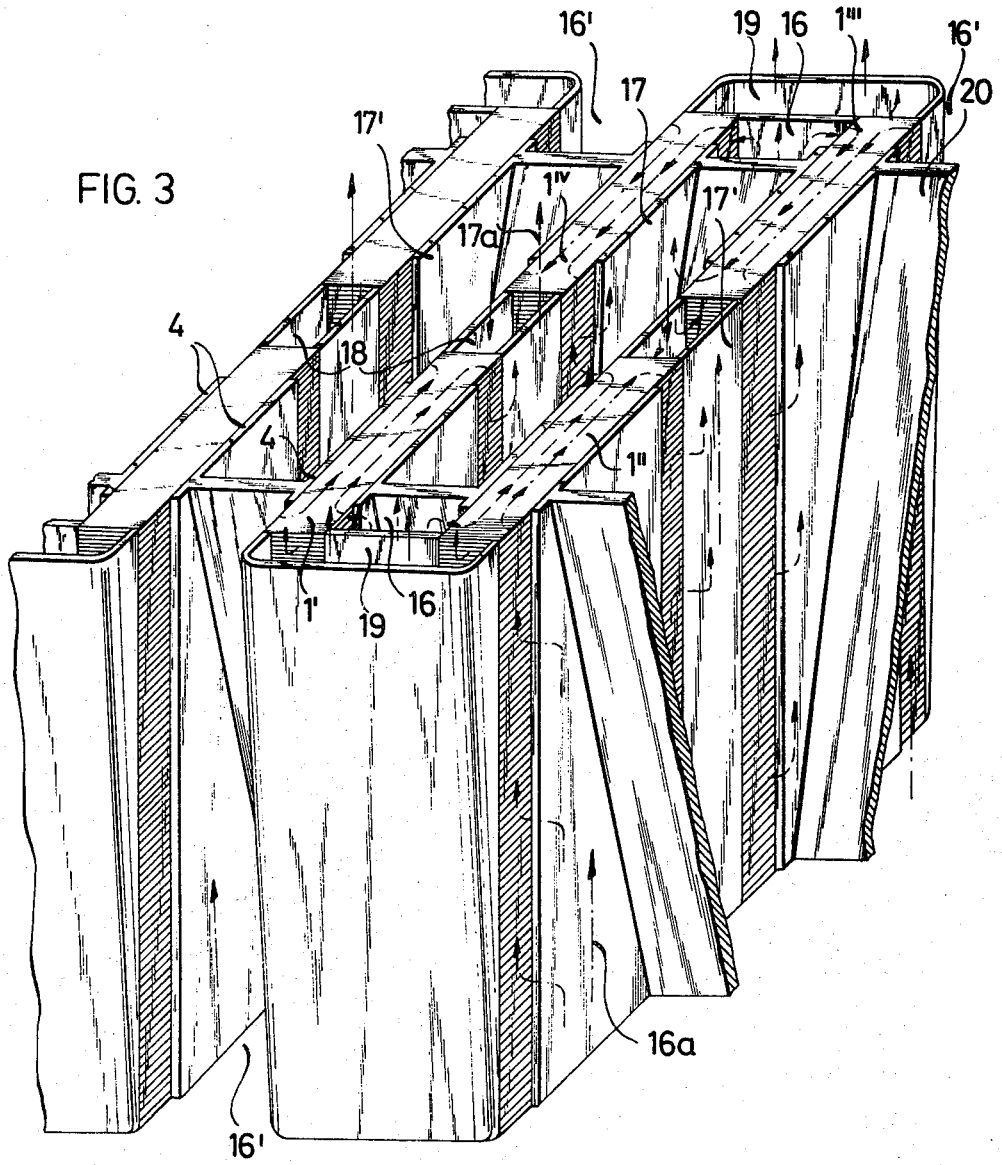
FIG. 3 is a perspective view of one module and a portion of another of a heat exchanger according to the present invention utilizing a multiplicity of matrices according to either FIG. 1 or FIG. 2.

A heat exchanger with a multiplicity of heat exchanger matrices according to the invention is diagrammatically shown in FIG. 3. The heat exchanger matrices $1^{I}$ to $1^{IV}$ there shown are all connected together in parallel and opposite matrices or, in other cases, neighboring matrices, are connected together by common inlet and outlet ducts 16, 17, 18 and 19. The flow cross-section of the inlet ducts 16 narrows down in the direction of flow 16*a* of the medium therein, whereas the outlet ducts 17 and 19 widen in the direction of flow 17*a*. With this construction of the inlet and outlet ducts, a uniform flow through the heat exchanger matrices is obtained. For the gradual narrowing down of the cross-section of the inlet channels 16 and the widening of the cross-section of the outlet channels 17, it is convenient to provide a diagonal supporting partition 20 between the cover plate 4 of oppositely located heat exchange matrices. The inlet duct 18 for the medium flowing through the intermediate spaces 8, 9 of the matrices are common to neighboring matrices $1^{I}$ and $1^{IV}$ in one case and $1^{II}$ and $1^{III}$ in the other, in both of these cases centered on one of the planes of symmetry of a module of four matrices. The outlet ducts 19 are at the ends of the module of four matrices each serve the intermediate spaces of two matrices. In the illustrative embodiment shown in FIG. 3, the outer strip edges of the matrices of a module of four matrices $1^{I}$ to $1^{IV}$ constitute the cold side of the unit, which is to say that the hot medium flows through the heat exchanger matrices through the inlet ducts 18 and after cooling is led off through the outlet ducts 19.

Modular units of four, as illustrated in FIG. 3, can be repeated in the manner illustrated in FIG. 3 to any extent desirable according to the requirements of the particular process in which the heat exchangers are used. In that case the heat exchanger matrices $1^{I}$ to $1^{IV}$ in the modules and the modules themselves are so combined by means of common inlets and outlets that, as seen from the direction of flow of the media into the heat exchanger matrices (see the arrows showing the direction of flow in FIG. 3), a mirror-image relation is established. The inlet channels 16' and outlet channels 17' between adjacent modules as thus combined also provide supporting members in the combined modular structure of the heat exchanger.

Figure 4:
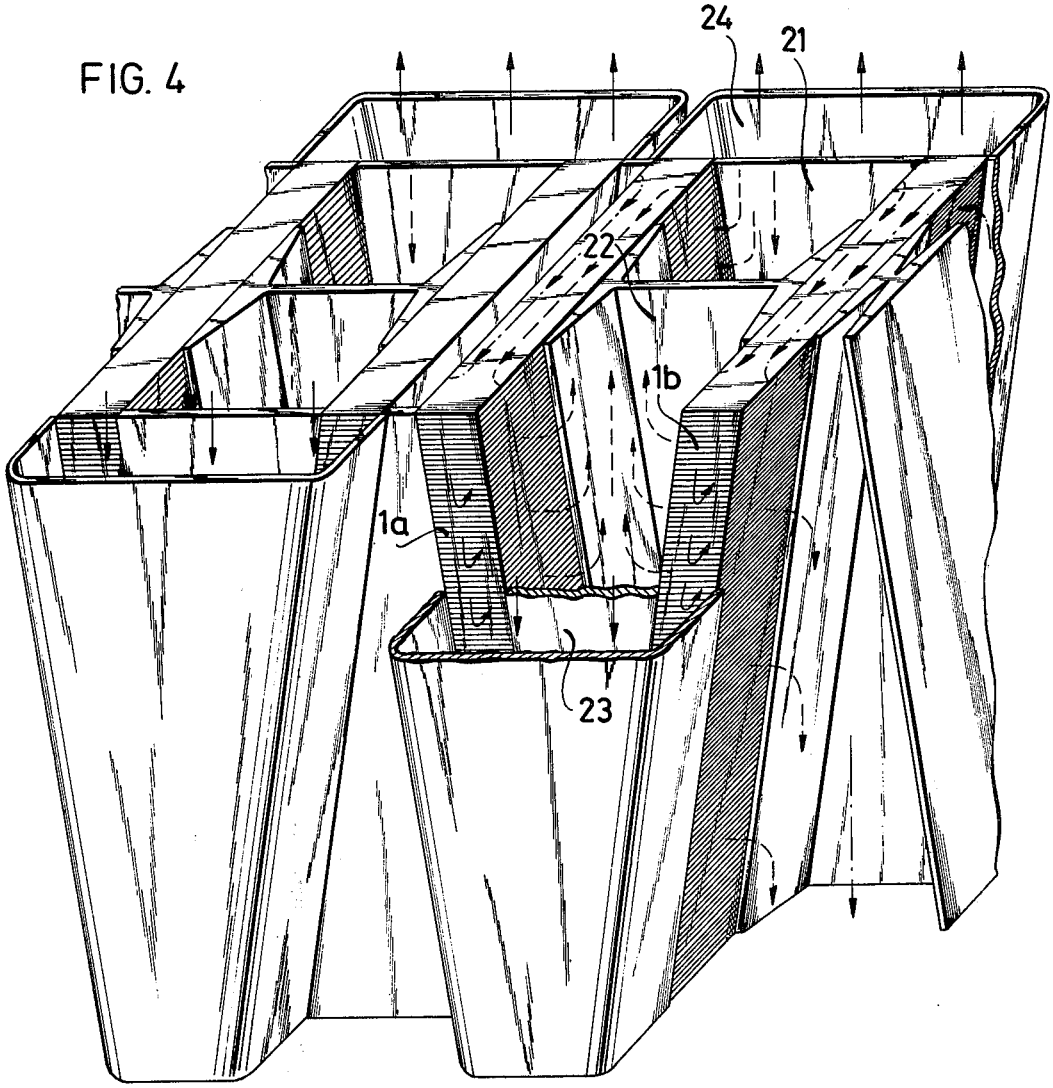
FIG. 4 is a perspective view of two modules, one partly broken away of another form of heat exchanger according to the invention utilizing a multiplicity of matrices according to FIG. 1 or FIG. 2.

FIG. 4 shows, rather schematically, an illustrative embodiment of a heat exchanger with heat exchange matrices 1*a*, 1*b* arranged in V-shaped pairs. In this arrangement, rather inherently inlet and outlet ducts 21, 22, 23, 24 are provided between neighboring heat exchanger matrices with the desired gradually changing flow cross-sections. In the modular heat exchanger shown in FIG. 4, the heat exchanger matrices provided in V-shaped configurations are constituted in horizontal rows. Heat exchanger matrices, however, can also be set into cylindrical heat exchangers with the benefits of the V-shaped pair configuration, in which case the neighboring heat exchanger matrices constitute an arrangement more or less in the form of a many-pointed star. It is desirable in a cylindrical heat exchanger that the inlet and outlet ducts for the media should make coaxial connections to the heat exchanger.

The heat exchangers shown by way of the above-described illustrative examples are particularly preferred for heat exchange operations in energy central stations utilizing a closed working gas cycle. In such cases, they are utilized as combination coolers for the precooling and intermediate cooling of the compressed working gas in the gas cycle. In such an operation, the heat to be extracted from the working gas in its precooling and intermediate cooling is transferred through a stream of cooling water that is caused to flow in the intermediate spaces between the two strips of each heat exchanger matrix according to the invention. The installation of heat exchangers according to the invention to operate as combination coolers of the above-described function makes it possible to achieve great space savings in energy central stations, particularly in nuclear power stations operating with a helium gas cycle.

The network-like constitution of heat exchangers composed of modules such as shown in FIG. 3 is also suited to provide heat exchange among a multiplicity of media. For this purpose, it is necessary merely to connect the inlet and outlet ducts of the various modules in some predetermined sequence by appropriate interconnecting ducts so as to bring any number of media into heat exchange relation with each other.

Although the invention has been described by reference to particular illustrative embodiments of heat exchanger matrices and of heat exchanger modules containing a plurality of matrices each, it will be understood that further variations and modifications are possible within the inventive concept.

We claim:

1. A heat exchanger matrix unit of the folded strip type for recuperative heat exchange among three flowing media, comprising in combination:

a first metal strip (2*a*) folded over in alternate opposite directions at regular intervals so as to form two interleaved series of chambers open to opposite sides of the strip;

a second metal strip (2*b*) folded in the same manner as the first and juxtaposed to the first so that ridges of a succession of folds of each strip are each in proximity to, but normally spaced by a gap from, a corresponding ridge of the other strip and the folds and chambers of each strip are in substantially mirror-image relation to those of the other strip;

closure means (5) for closing off, at the edges of said strips, the ends of the chambers formed by said strips which are open to the side of each strip facing away from the other strip, while leaving open the strip-edge ends of the chamber between the strips;

means including cover plates over portions of the openings of the external chambers of the two strips for facilitating the leading of a flow of a first medium through the external chambers of said first strip and the flow of a second medium through the external chambers of said second strip, and means for leading a third medium to flow through the chambers and gaps between the strips.

2. A heat exchanger matrix unit as defined in claim 1, in which said metal strips are so folded as to provide a multiplicity of flat portions of the strips disposed in substantially parallel planes.

3. A heat exchanger matrix unit as defined in claim 1, in which said means for facilitating the flow of said first and second media and said means for leading said third medium are means for producing flow of each medium through a corresponding set of chambers in parallel.

4. A heat exchanger for recuperative heat exchange among three flowing media utilizing a multiplicity of parallel-connected heat exchange matrix units of the folded strip type ($1^{I}$ to $1^{IV}$), each of said matrix units being a heat exchanger matrix unit as defined in claim 1, wherein there are provided in combination with said matrix unit, to form a combined structure, common inlet and outlet channels (16, 17, 18, 19) for each of said media in each case constituting a common part of a plurality of said matrix units.

5. A heat exchanger as defined in claim 4, in which said common inlet and outlet channels for a first and a second of said media are bounded in part by said cover plates of said matrix units and in part by partitions (20, 22) between back-to-back cover plates and are of a configuration such that the inlet channels (16) have a narrowing taper in the principal direction of flow (16*a*) of the corresponding medium and the outlet channels (17, 19) have a widening taper in the principal direction of flow (17*a*) of the corresponding medium, and in which heat exchanger the folded strip portions of said heat exchange matrix units (1*a*, 1*b*) are disposed in V-shaped pairs in adjacent matrix units (FIG. 4).

* * * * *